US009160107B2

(12) United States Patent
Beak et al.

(10) Patent No.: US 9,160,107 B2
(45) Date of Patent: Oct. 13, 2015

(54) CONNECTOR

(75) Inventors: SeungSeok Beak, Tokyo (JP); Koichi Kiryu, Nagano (JP); Takashi Yuba, Tokyo (JP); Daiei Iwamoto, Tokyo (JP); Akio Nakamura, Tokyo (JP); Masatoshi Noritake, Tokyo (JP); Keiichi Hirose, Tokyo (JP)

(73) Assignees: FUJITSU COMPONENT LIMITED, Tokyo (JP); NTT FACILITIES, INC., Tokyo (JP)

( * ) Notice: Subject to any disclaimer, the term of this patent is extended or adjusted under 35 U.S.C. 154(b) by 0 days.

(21) Appl. No.: 14/237,587

(22) PCT Filed: Aug. 10, 2012

(86) PCT No.: PCT/JP2012/070512

§ 371 (c)(1),
(2), (4) Date: Feb. 7, 2014

(87) PCT Pub. No.: WO2013/022093

PCT Pub. Date: Feb. 14, 2013

(65) Prior Publication Data

US 2014/0187072 A1 Jul. 3, 2014

(30) Foreign Application Priority Data

Aug. 11, 2011 (JP) ..... 2011-176411

(51) Int. Cl.
*H01R 13/703* (2006.01)
*H01R 13/629* (2006.01)
(Continued)

(52) U.S. Cl.
CPC ..... *H01R 13/629* (2013.01); *H01H 23/162* (2013.01); *H01H 2001/265* (2013.01)

(58) Field of Classification Search
CPC ..... H01R 13/7036; H01R 2103/00; H01R 13/703; H01R 33/955; H01R 13/70; H01R 13/717
See application file for complete search history.

(56) References Cited

U.S. PATENT DOCUMENTS 5,105,059 A * 4/1992 Sorenson et al. ..... 200/302.3
6,075,436 A * 6/2000 Hsu ..... 337/363
(Continued)

FOREIGN PATENT DOCUMENTS

JP 56-035728 U 4/1981
JP 58-035242 U 3/1983
(Continued)

OTHER PUBLICATIONS

International Search Report mailed on Nov. 13, 2012.

*Primary Examiner* — Gary Paumen
(74) *Attorney, Agent, or Firm* — IPUSA, PLLC

(57) ABSTRACT

A connector includes a connecting terminal to be connected to another connecting terminal of another connector, a fixed contact, a movable contact provided at one end of a movable plate, a movable spring connected to the movable plate, and an operation part that moves according to an operation performed by an operator. The connecting terminal is connected to one of the fixed contact and the movable contact. The operation part applies a force to a part of the movable spring in a direction that is substantially parallel to a direction of a force applied to operate the operation part, and causes the movable contact to contact the fixed contact. The direction of the force applied to operate the operation part is substantially parallel to a direction in which the movable contact moves.

6 Claims, 27 Drawing Sheets

(51) Int. Cl.
*H01H 23/16* (2006.01)
*H01H 1/26* (2006.01)

(56) References Cited

U.S. PATENT DOCUMENTS

2004/0027776 A1* 2/2004 Uotome et al. ..... 361/160
2010/0029141 A1 2/2010 Nakamura et al.
2012/0048705 A1* 3/2012 Ariyoshi et al. ..... 200/51 R

FOREIGN PATENT DOCUMENTS

JP 05-082208 4/1993
JP 2003-031301 1/2003
JP 2010-033967 2/2010
JP 2010-272371 12/2010
JP 2011-065835 3/2011

* cited by examiner

CONNECTOR

TECHNICAL FIELD

The present invention relates to a connector.

BACKGROUND ART

Generally, an electric apparatus is driven by electric power supplied from a power supply. An electric apparatus typically receives electric power via a connector from a power supply. Patent documents 1 and 2 disclose a connector unit including a protruding male connector and a hollow female connector that are fitted together to be electrically connected.

In recent years, as a measure to cope with global warming, it is being considered to use, even for power transmission in local areas, a direct-current high-voltage power that suffers less power loss during voltage conversion and power transmission and does not necessitate increasing the diameter of a cable. Supplying electric power in this manner is particularly preferable for an information apparatus such as a server that consumes a large amount of electric power.

On the other hand, when electric power supplied to an electric apparatus has a high voltage, the electric power may affect the human body and operations of electronic components. When such a high-voltage power is used for an information apparatus such as a server that is installed and maintained by a human, it is necessary to use, for electric connection, a connector that is different from a connector used for a normal alternating-current commercial power supply.

RELATED-ART DOCUMENTS

Patent Documents

[Patent document 1] Japanese Laid-Open Patent Publication No. 05-82208

[Patent document 2] Japanese Laid-Open Patent Publication No. 2003-31301

SUMMARY OF INVENTION

Technical Problem

When an electric power supplied from a power supply has a voltage greater than or equal to 100V or is a direct-current high-voltage power, a currently-available switch cannot be used without change for a connector for such an electric power. For example, when the electric power supplied from a power supply has a direct-current voltage of 400 V, it is dangerous to use a switch for an alternating-current voltage of 100V without change because sufficient safety and reliability cannot be ensured.

The present invention is made taking into account the above described problems. One object of the present invention is to provide a connector that can safely supply a high-voltage power. More specifically, one object of the present invention is to provide a connector that is safe and reliable and supports a direct-current power supply or a power supply with a voltage higher than the voltage of an existing commercial power supply.

Solution to Problem

According to an aspect of an embodiment of the present invention, there is provided a connector that includes a connecting terminal to be connected to another connecting terminal of another connector, a fixed contact, a movable contact provided at one end of a movable plate, a movable spring connected to the movable plate, and an operation part that moves according to an operation performed by an operator. The connecting terminal is connected to one of the fixed contact and the movable contact. The operation part applies a force to a part of the movable spring in a direction that is substantially parallel to a direction of a force applied to operate the operation part, and causes the movable contact to move and contact the fixed contact. The direction of the force applied to operate the operation part is substantially parallel to a direction in which the movable contact moves.

Advantageous Effects of Invention

An embodiment of the present invention provides a connector that supports a direct-current power supply or a power supply with a voltage higher than the voltage of an existing commercial power supply, and that can safely supply electric power from such a power supply.

BRIEF DESCRIPTION OF DRAWINGS

FIG. 2 is a top view of the plug connector according to the first embodiment;

DESCRIPTION OF EMBODIMENTS

Embodiments of the present invention are described below. The same reference number is assigned to the same component throughout the accompanying drawings, and repeated descriptions of the same component are omitted.

<<First Embodiment>>

<Configuration of Connector>

Figure 5:
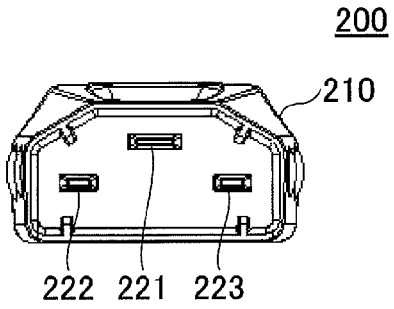
FIG. 5 is a front view of the plug connector according to the first embodiment.
Figure 6:
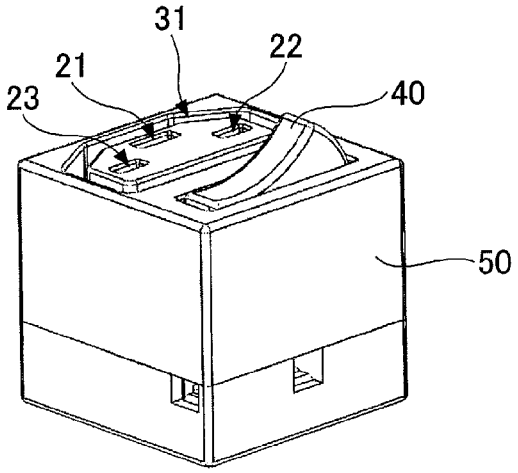
FIG. 6 is a perspective view of a connector according to the first embodiment.
Figure 7:
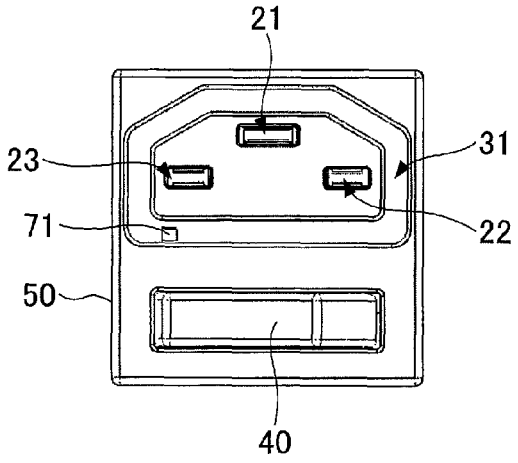
FIG. 7 is a front view of the connector according to the first embodiment.
Figure 8:
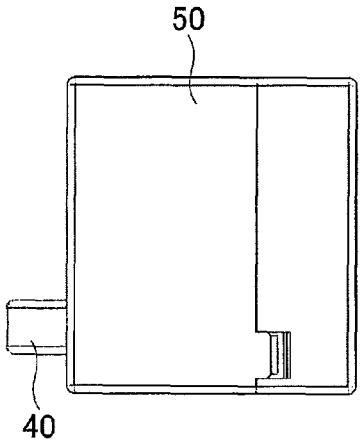
FIG. 8 is a side view of the connector according to the first embodiment.

A configuration of a connector according to a first embodiment is described. A connector of the present embodiment is a jack connector whose configuration is illustrated by FIGS. 6 through 8, and is to be connected to another connector that is a plug connector illustrated by FIGS. 1 through 5. The plug connector illustrated by FIGS. 1 through 5 and the connector corresponding to the jack connector illustrated by FIGS. 6 through 8 may be collectively referred to as a "connector unit".

Figure 1:
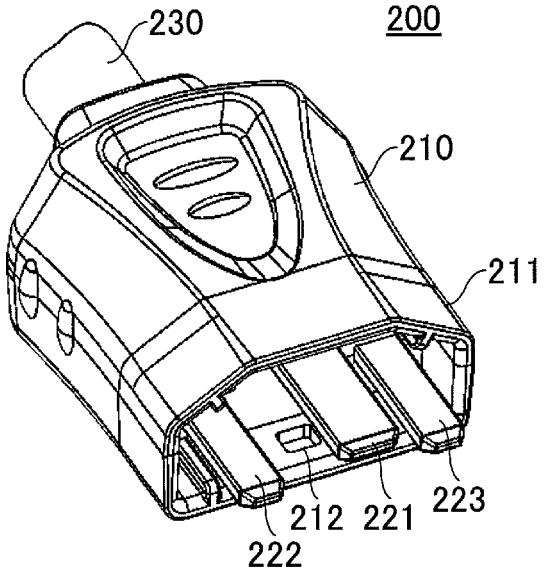
FIG. 1 is a perspective view of a plug connector according to a first embodiment.
Figure 3:
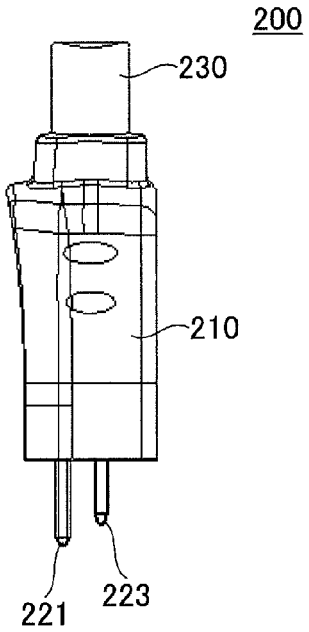
FIG. 3 is a side view of the plug connector according to the first embodiment.
Figure 4:
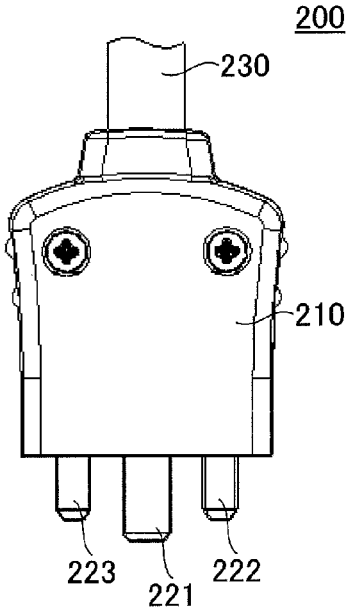
FIG. 4 is a bottom view of the plug connector according to the first embodiment.

First, a plug connector 200 is described with reference to FIGS. 1 through 5. FIG. 1 is a perspective view, FIG. 2 is a top view, FIG. 3 is a side view, FIG. 4 is a bottom view, and FIG. 5 is a front view of the plug connector 200. The plug connector 200 includes a cover 210 formed of, for example, an insulator and three plug terminals 221, 222, and 223 that are referred to as "other connecting terminals". A power cable 230 is connected to a side of the plug connector 200 that is opposite to a side where the three plug terminals 221, 222, and 223 are provided. The plug terminal 221 is a GND terminal and longer than the plug terminals 222 and 223. The plug terminals 222 and 223 are terminals to which electric power is supplied when they are electrically connected to jack terminals. A part of the cover 210, which is near the side where the plug terminals 221, 222, and 223 are provided, forms a protection part 211 that covers parts of the plug terminals 221, 222, and 223. Also, a connector connection opening 212 is formed in the protection part 211. The connector connection opening 212 prevents a connector of the present embodiment from being disconnected from the plug connector 200.

<Configuration of Connector>

Next, a connector of the present embodiment is described with reference to FIGS. 6 through 8. The connector of the present embodiment includes a switch. When the switch is turned on while the connector of the present embodiment and the plug connector 200 are fitted together and connected, electric power is supplied via the connector and the plug connector 200. FIG. 6 is a perspective view, FIG. 7 is a front view, and FIG. 8 is a side view of the connector of the present embodiment.

The connector of the present embodiment is covered by a case 50, and includes jack openings 21, 22, and 23 into which the plug terminals 221, 222, and 223 of the plug connector 200 are to be inserted; a groove 31 into which the protection part 211 of the plug connector 200 is to be inserted; and a seesaw switch operation part 40 that controls the supply of electric power when the plug connector 200 and the connector of the present embodiment are connected to each other. The seesaw switch operation part 40 has a curved upper surface. When a part of the seesaw switch operation part 40 near one end is pressed, the other end of the seesaw switch operation part 40 comes up and protrudes from the connector. Thus, the seesaw switch operation part 40 can be turned on or off by pressing a part near the protruding end of the seesaw switch operation part 40. Supply of electric power via the connector can be controlled by operating the seesaw switch operation part 40.

The seesaw switch operation part 40 is disposed on a surface of the connector to which the plug connector 200 is to be connected. The direction in which the plug connector 200 is inserted into the connector is substantially the same as the direction in which the seesaw switch operation part 40 is operated, i.e., pressed. This configuration makes it possible to quickly and easily turn off the seesaw switch operation part 40 and pull out the plug connector 200 from the connector.

Figure 9:
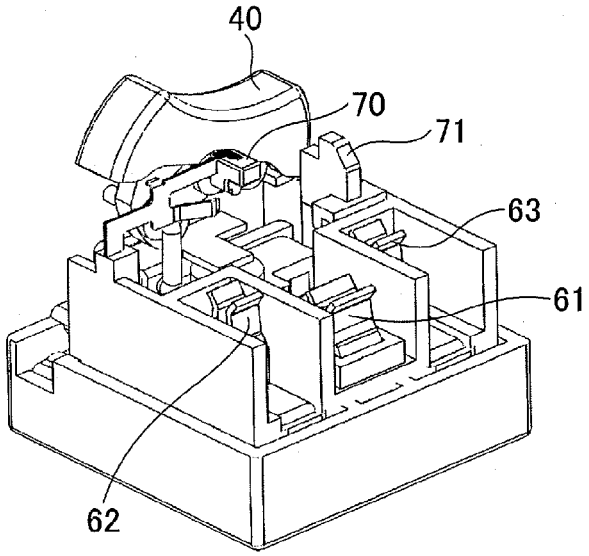
FIG. 9 is a perspective view (1) of an internal structure of the connector according to the first embodiment.
Figure 10:
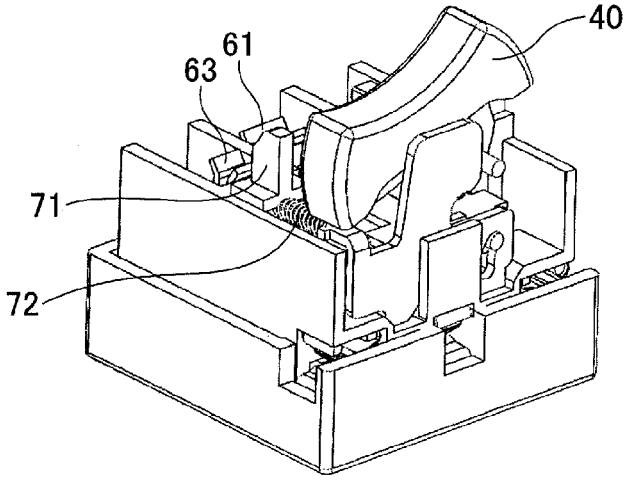
FIG. 10 is a perspective view (2) of the internal structure of the connector according to the first embodiment.
Figure 11:
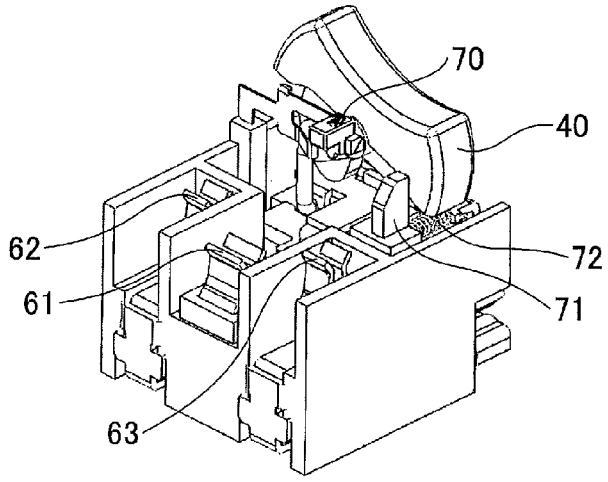
FIG. 11 is a perspective view (3) of the internal structure of the connector according to the first embodiment.

As illustrated by FIGS. 9 through 11, the connector of the present embodiment includes jack terminals 61, 62, and 63 in the jack openings 21, 22, and 23. The jack terminals 61, 62, and 63 are to be electrically connected with the plug terminals 221, 222, and 223. The connector also includes a hook 70 that moves along with the seesaw switch operation part 40. When the seesaw switch operation part 40 is turned on, the hook 70 protrudes toward the groove 31 and enters the connector connection opening 212 of the plug connector 200. This configuration prevents the plug connector 200 from being disconnected from the connector of the present embodiment while the seesaw switch operation part 40 is in the ON state. When the seesaw switch operation part 40 is turned off, the tip of the hook 70 is retracted toward the seesaw switch operation part 40. In other words, the hook 70 is moved out of the connector connection opening 212 of the plug connector 200 so that the plug connector 200 can be pulled out from the connector of the present embodiment. Thus, the connector of the present embodiment is configured to prevent disconnection of the plug connector 200 from the connector while electric power is being supplied.

The connector of the present embodiment also includes a protrusion 71 that functions as a detect switch. The protrusion 71 detects whether the connector of the present embodiment and the plug connector 200 are connected to each other. In other words, the protrusion 71 detects whether the connector of the present embodiment and the plug connector 200 are fitted together.

When the connector of the present embodiment and the plug connector 200 are not fitted together, a part of the protrusion 71 enters and projects toward the groove 31. In this state, the seesaw switch operation part 40 is locked and cannot be switched to the ON state. On the other hand, when the connector of the present embodiment and the plug connector 200 are fitted together, the protection part 211 of the plug connector 200 enters the groove 31 and presses the part of the protrusion 71 in the groove 31 toward the seesaw switch operation part 40. When the protrusion 71 is pressed, the seesaw switch operation part 40 locked in the OFF state is unlocked so that it can be switched to the ON state.

When the seesaw switch operation part 40 is turned off again, the plug connector 200 can be pulled out from the connector of the present embodiment. When the plug connector 200 is pulled out, the part of the protrusion 71 enters the groove 31 again by a restoring force of a spring 72. As a result, the seesaw switch operation part 40 is locked in the OFF state so that the seesaw switch operation part 40 cannot be switched to the ON state.

As described above, when the connector of the present embodiment and the plug connector 200 are connected to each other, the seesaw switch operation part 40 can be switched to the ON state by pressing the seesaw switch operation part 40. On the other hand, when the connector of the present embodiment and the plug connector 200 are not connected to each other, the seesaw switch operation part 40 is locked in the OFF state and cannot be switched to the ON state by pressing the seesaw switch operation part 40.

<On and Off Operations>

Next, on and off operations of the connector of the present embodiment are described with reference to FIGS. 12 and 13. The connector of the present embodiment includes two fixed parts 110*a* and 110*b* and two movable parts 120*a* and 120*b*. The fixed part 110*a* and the movable part 120*a* constitute one switch, and the fixed part 110*b* and the movable part 120*b* constitute another switch. Thus, the connector of the present embodiment includes two switches.

The fixed part 110*a* includes a fixed contact 111*a* and a connecting part 112*a*. The connecting part 112*a* is electrically connected with the jack terminal 62. The movable part 120*a* includes a movable contact 121*a*, a movable plate 122*a*, a snap action spring 123*a*, and a terminal 124*a*. The terminal 124*a* is electrically connected with, for example, a negative terminal of a power cable (not shown). The switch including the fixed part 110*a* and the movable part 120*a* is turned on when the movable contact 121*a* is brought into contact with the fixed contact 111*a*, and is turned off when the movable contact 121*a* is moved away from the fixed contact 111*a*.

The fixed part 110*b* includes a fixed contact 111*b* and a connecting part 112*b*. The connecting part 112*b* is electrically connected with the jack terminal 63. The movable part 120*b* includes a movable contact 121*b*, a movable plate 122*b*, a snap action spring 123*b*, and a terminal. The terminal is electrically connected with, for example, a positive terminal of the power cable (not shown). The switch including the fixed part 110*b* and the movable part 120*b* is turned on when the movable contact 121*b* is brought into contact with the fixed contact 111*b*, and is turned off when the movable contact 121*b* is moved away from the fixed contact 111*b*.

More specifically, when parts of the snap action springs 123*a* and 123*b* of the movable parts 120*a* and 120*b* are pressed by a pressing mechanism 130, the movable contacts 121*a* and 121*b* are moved toward the fixed contacts 111*a* and 111*b* and brought into contact with the corresponding fixed contacts 111*a* and 111*b*, and as a result the connector is turned on.

The pressing mechanism 130 has a shape like a square bracket, and includes contact parts 131*a* and 131*b* for pressing parts of the snap action springs 123*a* and 123*b* and a body 132. The contact part 131*a* and the contact part 131*b* are connected to each other via the body 132. A press contact part 133 is provided on a central part of the body 132. The contact parts 131*a* and 131*b* are configured to press parts of the snap action springs 123*a* and 123*b* substantially at the same time.

Figure 13:
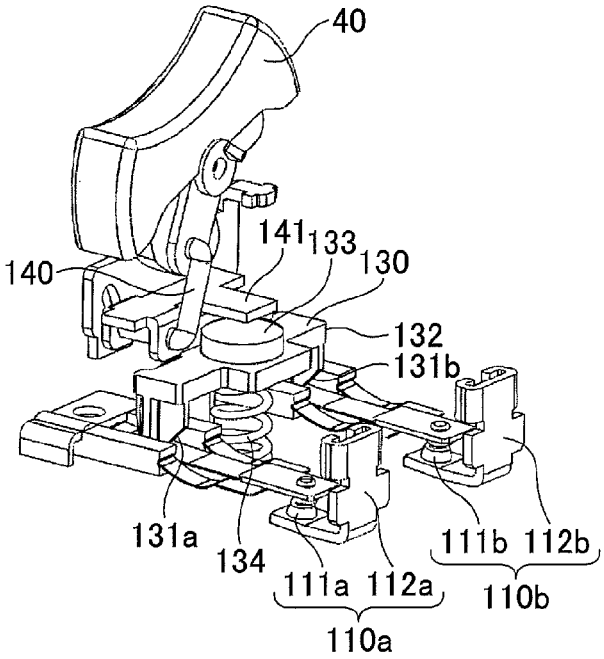
FIG. 13 is a perspective view of the internal structure of the connector in an ON state according to the first embodiment.

As illustrated by FIG. 13, when the seesaw switch operation part 40 is pressed to turn the switch on, a pressing part 141 presses the press contact part 133 of the pressing mechanism 130 via a link 140, and the pressing mechanism 130 moves downward toward the snap action springs 123*a* and 123*b*. Parts of the snap action springs 123*a* and 123*b* are pressed by the contact parts 131*a* and 131*b* of the pressing mechanism 130. As a result, the movable contact 121*a* is brought into contact with the fixed contact 111*a*, the movable contact 121*b* is brought into contact with the fixed contact 111*b*, and the connector is turned on.

Figure 12:
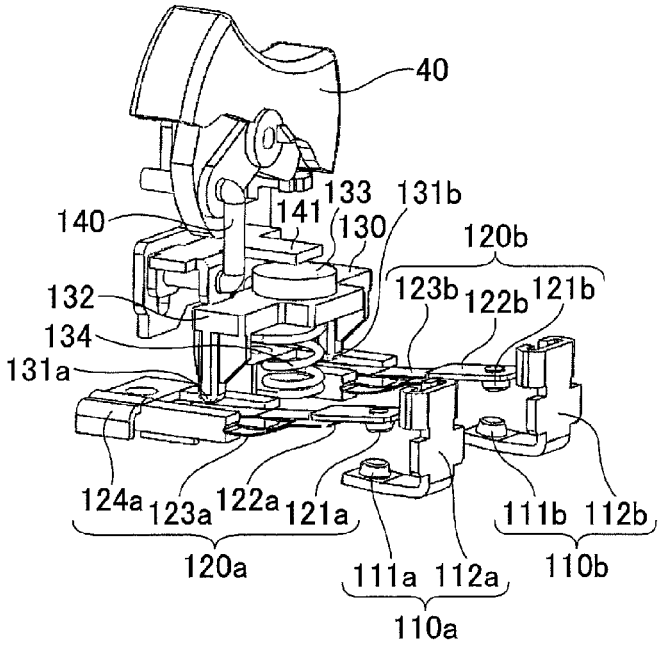
FIG. 12 is a perspective view of the internal structure of the connector in an OFF state according to the first embodiment.

As illustrated by FIG. 12, when the seesaw switch operation part 40 is switched to the OFF state, the pressing part 141 pressing the pressing mechanism 130 moves upward, and the pressing mechanism 130 is lifted upward by a restoring force of a spring 134. As a result, the contact parts 131*a* and 131*b*, which have been pressing the snap action springs 123*a* and 123*b*, move away from the snap action springs 123*a* and 123*b*, the movable contact 121*a* moves away from the fixed contact 111*a*, the movable contact 121*b* moves away from the fixed contact 111*b*, and the connector is turned off.

In the connector of the present embodiment, the direction in which the seesaw switch operation part 40 is operated is substantially parallel to the direction in which the contact parts 131*a* and 131*b* press the snap action springs 123*a* and 123*b*, and is also substantially parallel to a moving direction in which the movable contacts 121*a* and 121*b* are moved to be brought into contact with the fixed contacts 111*a* and 111*b*. With this configuration, a force applied to turn on the seesaw switch operating part 40 is directly transmitted to the contact parts 131*a* and 131*b*, and the snap action springs 123*a* and 123*b* can be pressed with a strong force. When the snap action springs 123*a* and 123*b* are pressed with a strong force, the snap action springs 123*a* and 123*b* are deformed and a strong restoring force is generated. This in turn makes it possible to quickly move the movable contact 121*a* away from the fixed contact 111*a* and the movable contact 121*b* away from the fixed contact 111*b* with a strong force when the seesaw switch operation part 40 is turned off.

<Snap Action Spring>

Figure 14:
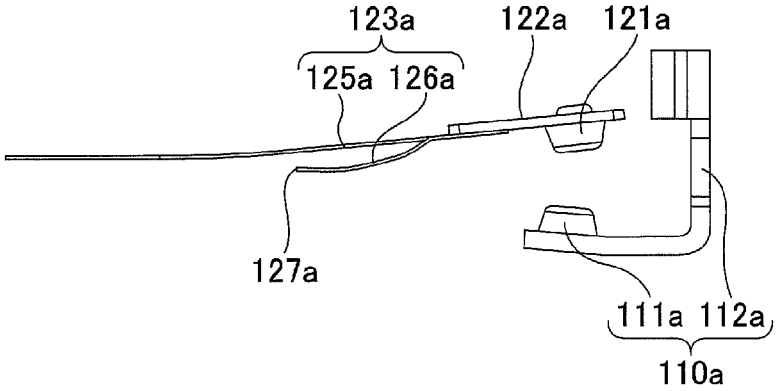
FIG. 14 is a drawing (1) illustrating a snap action spring.
Figure 15:
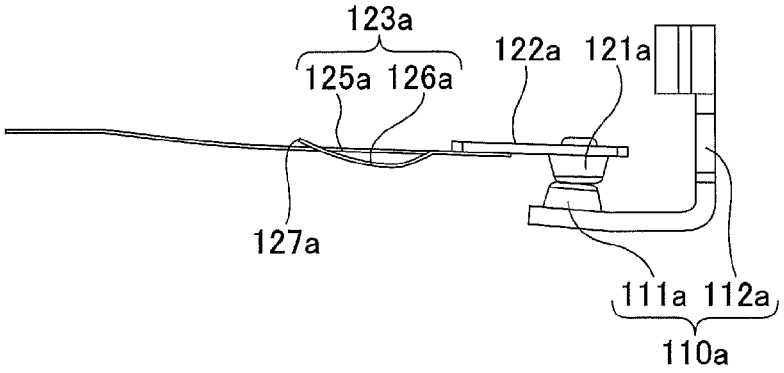
FIG. 15 is a drawing (2) illustrating a snap action spring.
Figure 16:
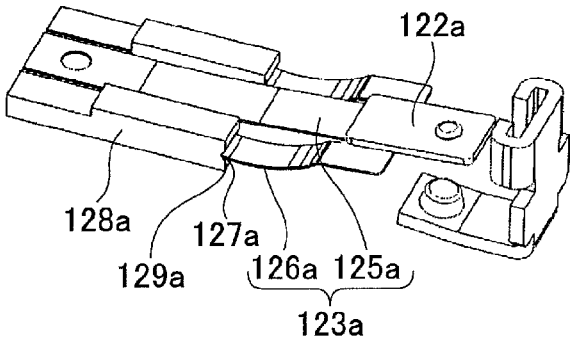
FIG. 16 is a drawing (3) illustrating a snap action spring.

The snap action spring 123*a* is described with reference to FIGS. 14 through 16. The snap action spring 123*a* includes a spring body 125*a* and a curved part 126*a*. An end of the curved part 126*a* is referred to as a curved part end 127*a* and is in contact with a V-shaped mounting part end 129*a* of a movable part mounting part 128*a*. As illustrated by FIG. 15, when an operation to turn on the seesaw switch operation part 40 is performed, a force is applied to the snap action spring 123*a*, the spring body 125*a* of the snap action spring 123*a* is bent, and the movable contact 121*a* is brought into contact with the fixed contact 111*a*. In this state, the curved part 126*a* is deformed and a force is applied in a direction in which the curved part 126*a* contracts. When an operation to turn off the seesaw switch operation part 40 is performed, the external force being applied to the snap action spring 123*a* is released, and a strong restoring force of the curved part 126*a*, i.e., a force generated by the curved part 126*a* returning to a state illustrated in FIG. 14, causes the movable contact 121*a* to move away from the fixed contact 111*a*. This configuration makes it possible to quickly extinguish an arc generated between the fixed contact 111*a* and the movable contact 121*a*. That is, the above configuration makes it possible to reduce a period of time for which an arc is generated between the fixed contact 111*a* and the movable contact 121*a*, reduce abrasion of materials forming the fixed contact 111*a* and the movable contact 121*a* caused by the arc, and lengthen the life and improve the reliability of the connector. The above descriptions on the snap action spring 123*a* also apply to the snap action spring 123*b*.

Figure 17:
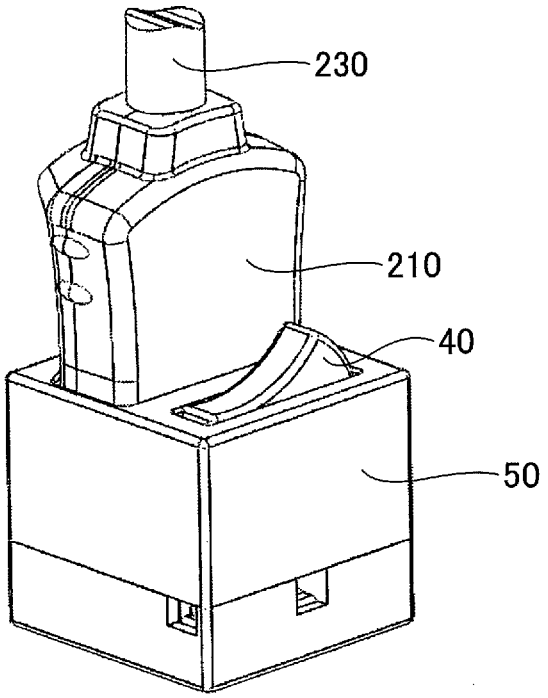
FIG. 17 is a perspective view of the connector in an OFF state according to the first embodiment.
Figure 18:
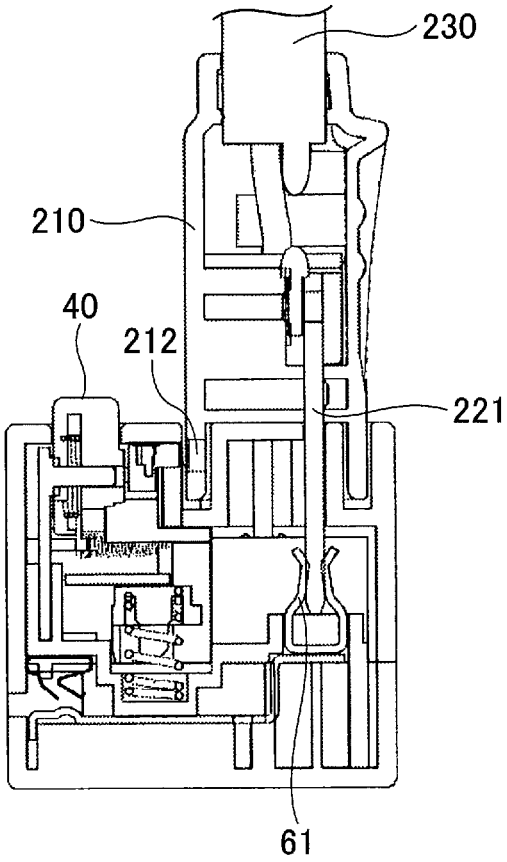
FIG. 18 is a cut-away side view (1) of the connector in an OFF state according to the first embodiment.
Figure 19:
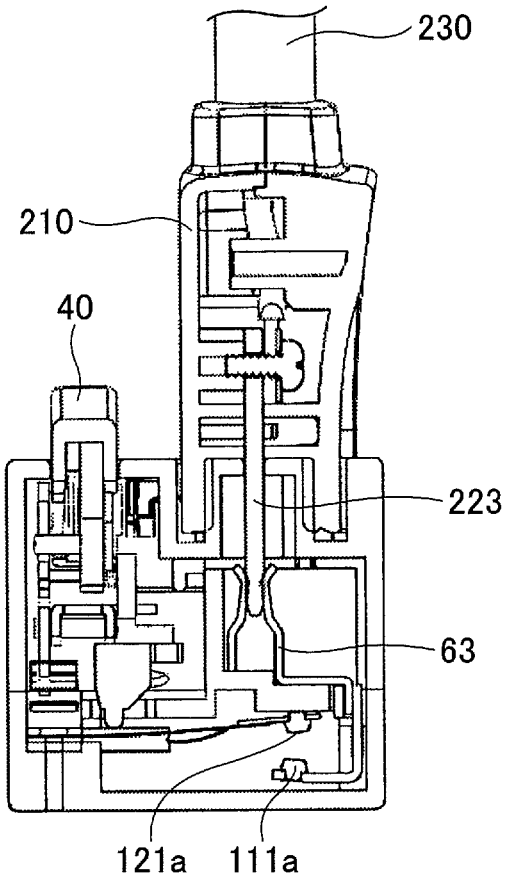
FIG. 19 is a cut-away side view (2) of the connector in an OFF state according to the first embodiment.

Next, the seesaw switch operation part 40 of the connector of the present embodiment is described. As illustrated by FIGS. 17 through 19, when the connector of the present embodiment and the plug connector 200 are fitted together and the seesaw switch operation part 40 is in a turned off state, the jack terminal 62 of the connector of the present embodiment and the plug terminal 222 of the plug connector 200 are fitted together, and the jack terminal 63 of the connector of the present embodiment and the plug terminal 223 of the plug connector 200 are fitted together. However, as described above, because the pressing mechanism 130 is not being pressed by the pressing part 141, the fixed contact 111*a* and the movable contact 121*a* are not in contact with each other, and the fixed contact 111*b* and the movable contact 121*b* are not in contact with each other. Therefore, in this state, electric power is not supplied to the plug connector 200. FIG. 17 is a drawing illustrating the connector of the present embodiment in the OFF state and the plug connector 200, FIG. 18 is a cut-away side view of an area where the jack terminal 61 is located, and FIG. 19 is a cut-away side view of an area where the jack terminal 63 is located.

Figure 20:
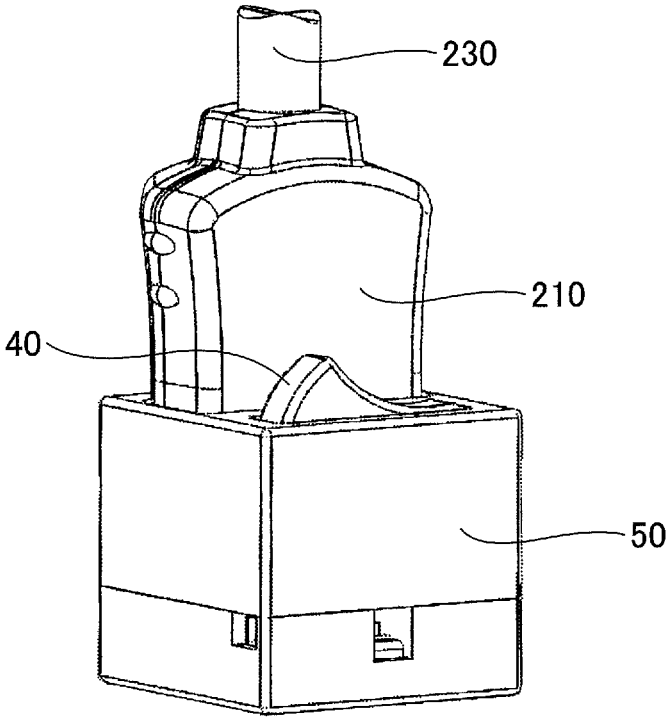
FIG. 20 is a perspective view of the connector in an ON state according to the first embodiment.
Figure 21:
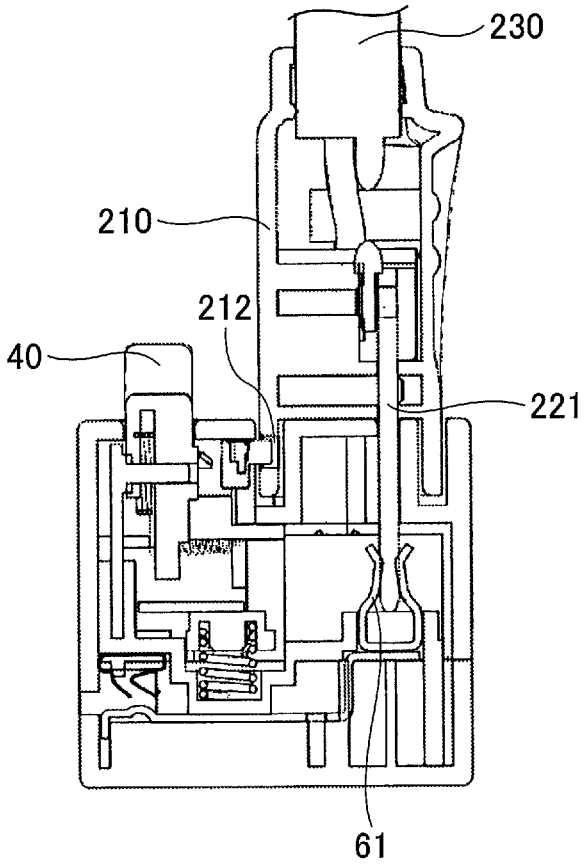
FIG. 21 is a cut-away side view (1) of the connector in an ON state according to the first embodiment.
Figure 22:
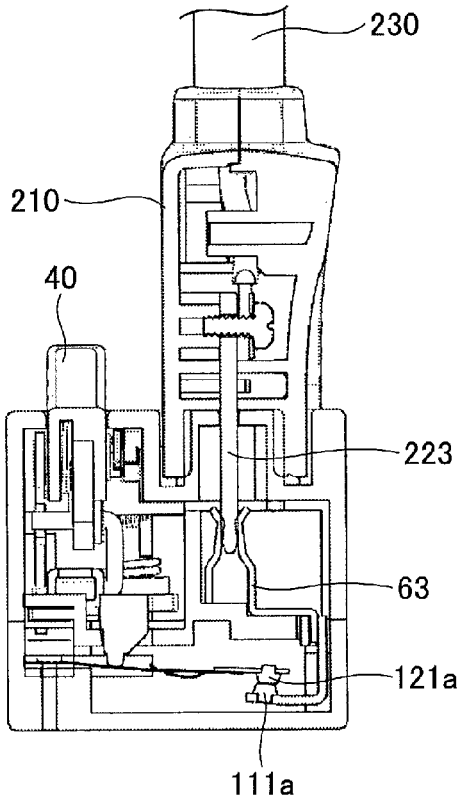
FIG. 22 is a cut-away side view (2) of the connector in an ON state according to the first embodiment.

On the other hand, as illustrated by FIGS. 20 through 22, when the seesaw switch operation part 40 is in a turned on state, the pressing part 141 presses the pressing mechanism 130, the movable contact 121*a* contacts the fixed contact 111*a*, the movable contact 121*b* contacts the fixed contact 111*b*, and electric power is supplied to the plug connector 200. FIG. 20 is a drawing illustrating the connector of the present embodiment in the ON state and the plug connector 200, FIG. 21 is a cut-away side view of an area where the jack terminal 61 is located, and FIG. 22 is a cut-away side view of an area where the jack terminal 63 is located.

Figure 23:
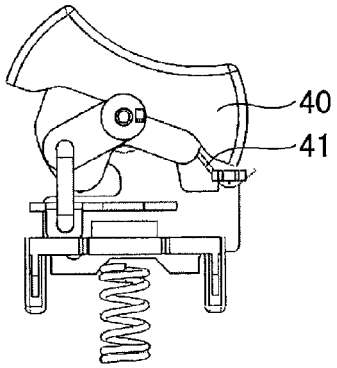
FIG. 23 is a drawing (1) illustrating a seesaw switch operation part.
Figure 24:
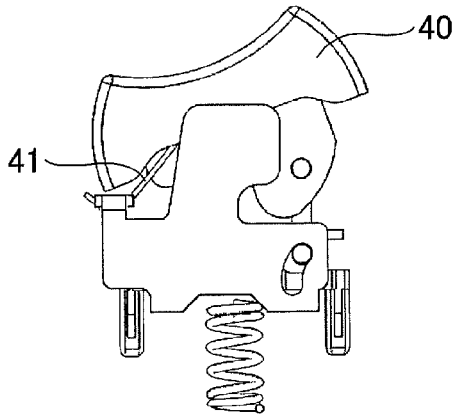
FIG. 24 is a drawing (2) illustrating the seesaw switch operation part.
Figure 25:
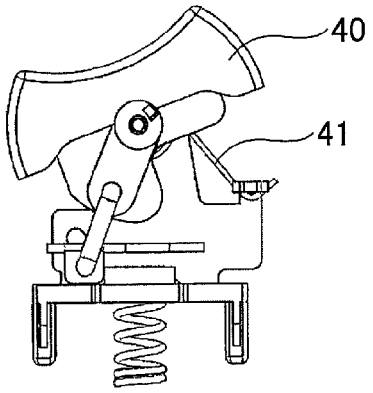
FIG. 25 is a drawing (3) illustrating the seesaw switch operation part.
Figure 26:
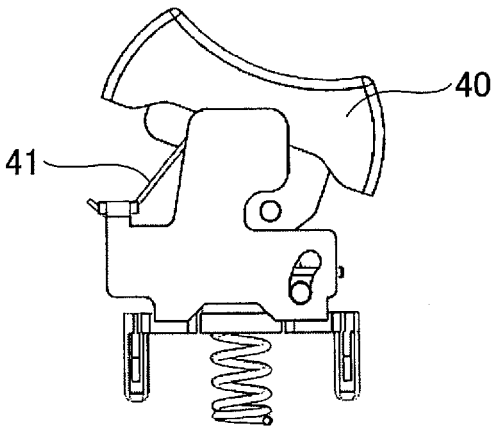
FIG. 26 is a drawing (4) illustrating the seesaw switch operation part.
Figure 27:
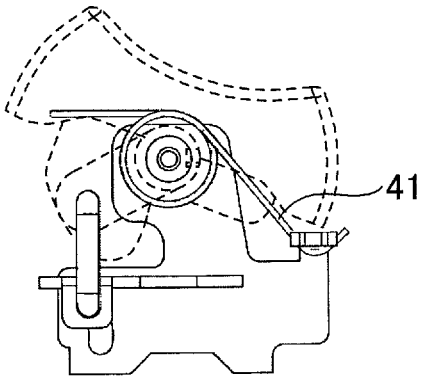
FIG. 27 is a drawing (5) illustrating the seesaw switch operation part.

The ON and OFF operations described above are performed by operating the seesaw switch operation part 40. That is, when the seesaw switch operation part 40 is changed from the OFF state illustrated by FIGS. 23 and 24 into the ON state illustrated by FIGS. 25 and 26, the pressing part 141 presses the pressing mechanism 130, the pressed pressing mechanism 130 applies a force to the snap action springs 123*a* and 123*b*, the movable contact 121*a* contacts the fixed contact 111*a*, and the movable contact 121*b* contacts the fixed contact 111*b*. When the seesaw switch operation part 40 is changed from the ON state illustrated by FIGS. 25 and 26 into the OFF state illustrated by FIGS. 23 and 24, it is preferable to switch the seesaw switch operation part 40 to the OFF state as quickly as possible to reduce the time for which an arc is generated. For this purpose, as illustrated by FIG. 27, a torsion spring 41 is provided in the seesaw switch operation unit 40. The torsion spring 41 is wound such that the rotational axis of the seesaw switch operation unit 40 comes substantially in the center of the torsion spring 41. In the ON state illustrated by FIGS. 25 and 26, a restoring force of the torsion spring 41 is applied in a direction to bring the seesaw switch operation unit 40 into the OFF state illustrated by FIGS. 23 and 24. FIG. 23 is a front view and FIG. 24 is a rear view of a part of the internal structure of a switch of the present embodiment in the OFF state. FIG. 25 is a front view and FIG. 26 is a rear view of a part of the internal structure of a switch of the present embodiment in the ON state.

ON and OFF operations of the seesaw switch operation unit 40 can be performed while the plug connector 200 is inserted in (or fitted into) the connector of the present embodiment. When the plug connector 200 is not inserted in the connector of the present embodiment, the seesaw switch operation unit 40 cannot be operated into the ON state, i.e., is kept in the OFF state, and electric power is not supplied to the jack terminals 62 and 63.

<<Second Embodiment>>

Next, a second embodiment is described. Similarly to the connector of the first embodiment, a connector according to a second embodiment is to be connected to the plug connector 200.

<Configuration of Connector>

Figure 28:
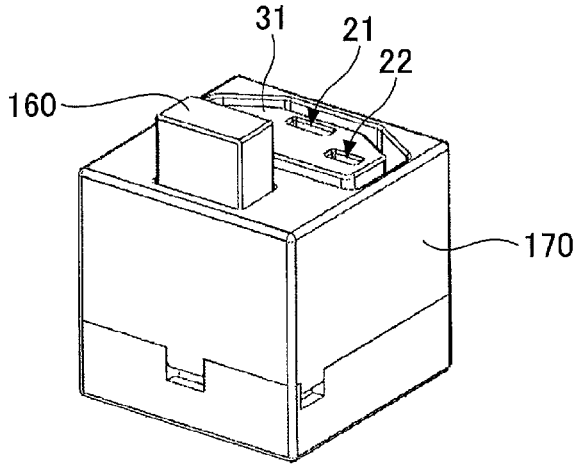
FIG. 28 is a perspective view of a connector according to a second embodiment.
Figure 29:
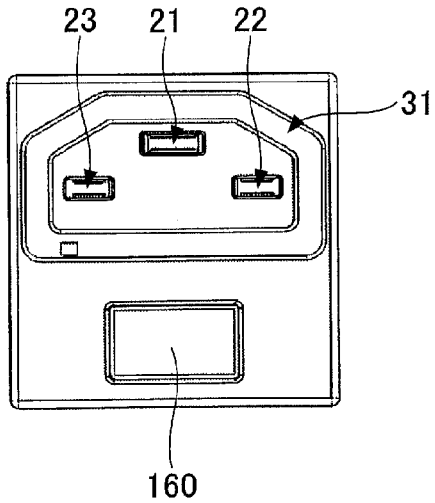
FIG. 29 is a front view of the connector according to the second embodiment.
Figure 30:
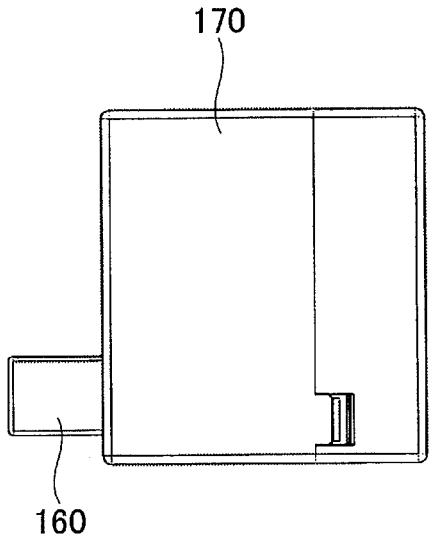
FIG. 30 is a side view of the connector of the second embodiment.

A connector of the present embodiment is described with reference to FIGS. 28 through 30. The connector of the present embodiment includes a push lock switch. When the push lock switch is turned on while the connector of the present embodiment and the plug connector 200 are fitted together and connected, electric power is supplied via the connector and the plug connector 200. FIG. 28 is a perspective view, FIG. 29 is a front view, and FIG. 30 is a side view of the connector of the present embodiment.

The connector of the present embodiment is covered by a case 170, and includes jack openings 21, 22, and 23 into which the plug terminals 221, 222, and 223 of the plug connector 200 are to be inserted; a groove 31 into which the protection part 211 of the plug connector 200 is to be inserted; and a push switch operation part 160 for controlling the supply of electric power when the plug connector 200 and the connector of the present embodiment are connected to each other. Thus, the push switch operation part 160 is used to operate the push lock switch. The push lock switch can be turned on or off by pressing the push switch operation part 40. Supply of electric power via the connector can be controlled by operating the push switch operation part 160. In the present embodiment, the push lock switch indicates a part that can be switched from an OFF state to an ON state by pressing the push switch operation part 160, can be kept in the ON state even when the pressing force is released, and can be switched from the ON state to the OFF state by pressing the push switch operation part 160 again.

Figure 31:
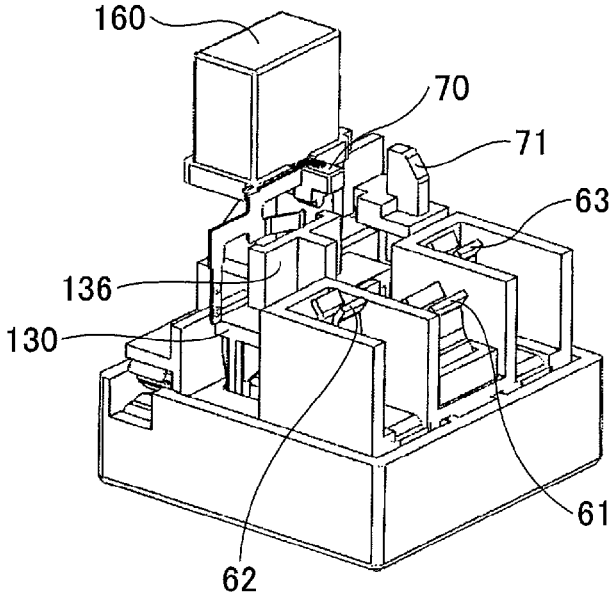
FIG. 31 is a perspective view (1) of an internal structure of the connector according to the second embodiment.
Figure 32:
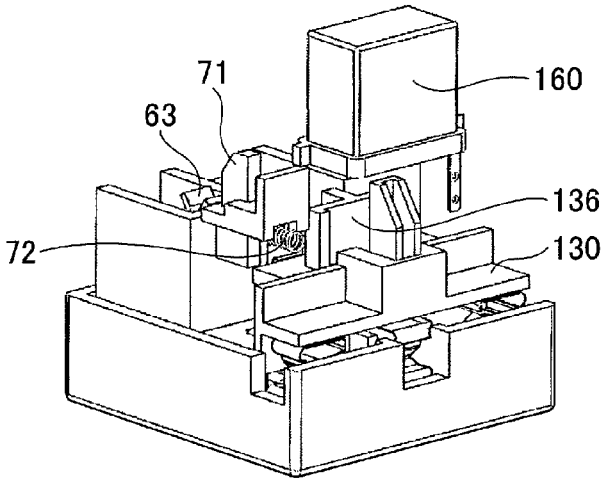
FIG. 32 is a perspective view (2) of the internal structure of the connector according to the second embodiment.
Figure 33:
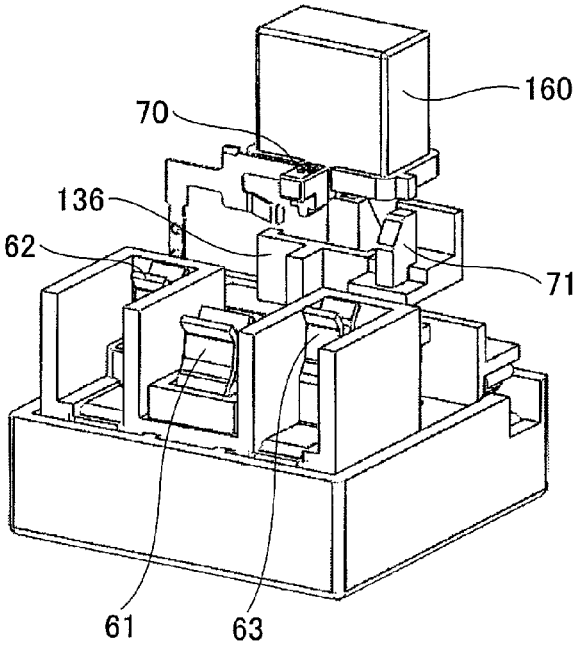
FIG. 33 is a perspective view (2) of the internal structure of the connector according to the second embodiment.

The push switch operation part 160 is disposed on a surface of the connector to which the plug connector 200 is to be connected. The direction in which the plug connector 200 is inserted into the connector is substantially the same as the direction in which the push switch operation part 160 is operated, i.e., pressed. This configuration makes it possible to quickly and easily turn off the push switch operation part 160 and pull out the plug connector 200 from the connector As illustrated by FIGS. 31 through 33, the connector of the present embodiment also includes jack terminals 61, 62, and 63 in the jack openings 21, 22, and 23. The jack terminals 61, 62, and 63 are to be electrically connected with the plug terminals 221, 222, and 223. The connector also includes a hook 70 that moves along with the push switch operation part 160. When the push switch operation part 160 is operated to be in the ON state, the hook 70 protrudes toward the groove 31 and enters the connector connection opening 212 of the plug connector 200. This configuration prevents the plug connector 200 from being disconnected from the connector of the present embodiment while the push switch operation part 160 is in the ON state. When the push switch operation part 160 is turned off, the tip of the hook 70 is retracted toward the push switch operation part 160. In other words, the hook 70 is moved out of the connector connection opening 212 of the plug connector 200 so that the plug connector 200 can be pulled out from the connector of the present embodiment. Thus, the connector of the present embodiment is configured to prevent disconnection of the plug connector 200 from the connector while electric power is being supplied.

The connector of the present embodiment also includes a protrusion 71 that functions as a detect switch. The protrusion 71 detects whether the connector of the present embodiment and the plug connector 200 are connected to each other. In other words, the protrusion 71 detects whether the connector of the present embodiment and the plug connector 200 are fitted together.

When the connector of the present embodiment and the plug connector 200 are not fitted together, a part of the protrusion 71 enters the groove 31. In this state, the push switch operation part 160 is locked in the OFF state and cannot be turned on. On the other hand, when the connector of the present embodiment and the plug connector 200 are fitted together, the protection part 211 of the plug connector 200 enters the groove 31 and presses the part of the protrusion 71 in the groove 31 toward the push switch operation part 160. When the protrusion 71 is pressed, the push switch operation part 160 locked in the OFF state is unlocked so that it can be turned on.

When the push switch operation part 160 is turned off again, the plug connector 200 can be pulled out from the connector of the present embodiment. When the plug connector 200 is pulled out, the part of the protrusion 71 is caused by a restoring force of a spring 72 to enter the groove 31 again. As a result, the push switch operation part 160 is locked in the OFF state so that it cannot be turned on.

As described above, when the connector of the present embodiment and the plug connector 200 are connected to each other, the push switch operation part 160 can be turned on by pressing. On the other hand, when the connector of the present embodiment and the plug connector 200 are not connected to each other, the push switch operation part 160 is locked in the OFF state and cannot be turned on by pressing.

<On and Off Operations>

Next, on and off operations of the connector of the present embodiment are described with reference to FIGS. 34 and 35. The connector of the present embodiment includes two fixed parts 110*a* and 110*b* and two movable parts 120*a* and 120*b*. The fixed part 110*a* and the movable part 120*a* constitute one switch, and the fixed part 110*b* and the movable part 120*b* constitute another switch. Thus, the connector of the present embodiment includes two switches.

The fixed part 110*a* includes a fixed contact 111*a* and a connecting part 112*a*. The connecting part 112*a* is electrically connected with the jack terminal 62. The fixed part 120*a* includes a movable contact 121*a*, a movable plate 122*a*, a snap action spring 123*a*, and a terminal 124*a*. The terminal 124*a* is electrically connected with, for example, a negative terminal of a power cable (not shown). The switch including the fixed part 110*a* and the movable part 120*a* is turned on when the movable contact 121*a* is brought into contact with the fixed contact 111*a*, and is turned off when the movable contact 121*a* is moved away from the fixed contact 111*a*.

The fixed part 110*b* includes a fixed contact 111*b* and a connecting part 112*b*. The connecting part 112*b* is electrically connected with the jack terminal 63. The movable part 120*b* includes a movable contact 121*b*, a movable plate 122*b*, a snap action spring 123*b*, and a terminal. The terminal is electrically connected with, for example, a positive terminal of the power cable (not shown). The switch including the fixed part 110*b* and the movable part 120*b* is turned on when the movable contact 121*b* is brought into contact with the fixed contact 111*b*, and is turned off when the movable contact 121*b* is moved away from the fixed contact 111*b*.

In the connector of the present embodiment, the direction in which the push switch operation part 160 is operated is substantially parallel to the direction in which a contact part 131*a* and another contact part press the snap action springs 123*a* and 123*b*, and is also substantially parallel to a moving direction in which the movable contacts 121*a* and 121*b* are moved and brought into contact with the fixed contacts 111*a* and 111*b*. With this configuration, a force applied to turn on the push switch operating part 160 is directly transmitted to the contact part 131*a* and the contact part 131*b*. Thus, this configuration makes it possible to press the snap action springs 123*a* and 123*b* with a strong force. When the snap action springs 123*a* and 123*b* are pressed with a strong force, the snap action springs 123*a* and 123*b* are deformed and a strong restoring force is generated. This in turn makes it possible to quickly move the movable contact 121*a* and the movable contact 121*b* away from the fixed contact 111*a* and the fixed contact 111*b* with a strong force when the push switch operation part 160 is turned off.

More specifically, when parts of the snap action springs 123*a* and 123*b* of the movable parts 120*a* and 120*b* are pressed by a pressing mechanism 130, the movable contacts 121*a* and 121*b* are moved toward the fixed contacts 111*a* and 111*b* and brought into contact with the corresponding fixed contacts 111*a* and 111*b*, and as a result the connector is turned on.

The pressing mechanism 130 has a shape like a square bracket, and includes the contact part 131*a* and the contact part 131*b* for pressing parts of the snap action springs 123*a* and 123*b*, and a body 132. The contact part 131*a* and the contact part 131*b* are connected to each other via the body 132. A protrusion 136 is provided on a central part of the body 132. The contact part 131*a* and the contact part 131*b* are configured to press parts of the snap action springs 123*a* and 123*b* substantially at the same time.

Figure 35:
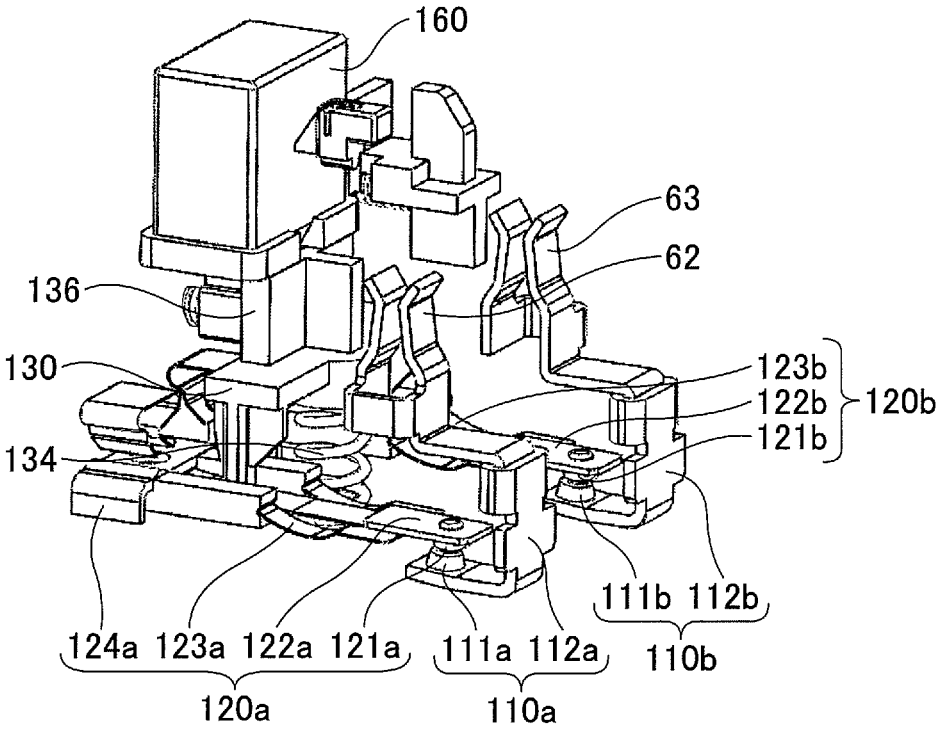
FIG. 35 is a perspective view of the internal structure of the connector in an ON state according to the second embodiment.

As illustrated by FIG. 35, when the push switch operation part 160 is pressed to turn it on, the protrusion 136 presses the pressing mechanism 130 downward toward the snap action springs 123*a* and 123*b*. Parts of the snap action springs 123*a* and 123*b* are pressed by the contact part 131*a* and the contact part 131*b* of the pressing mechanism 130. As a result, the movable contact 121*a* is brought into contact with the fixed contact 111*a*, the movable contact 121*b* is brought into contact with the fixed contact 111*b*, and the connector is turned on.

Figure 34:
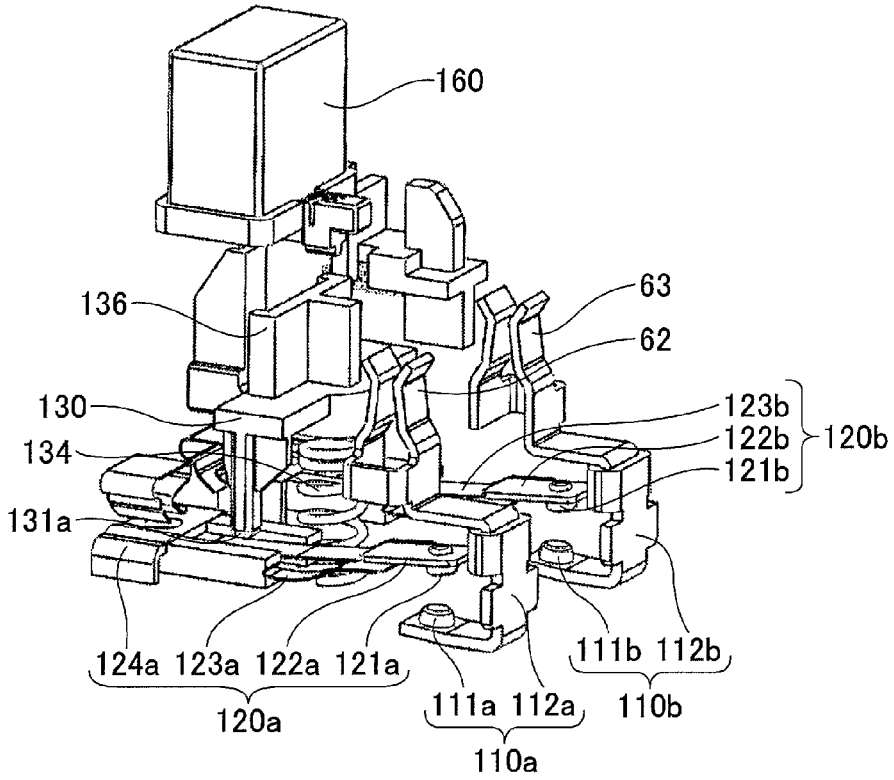
FIG. 34 is a perspective view of the internal structure of the connector in an OFF state according to the second embodiment.

As illustrated by FIG. 34, when the push switch operation part 160 is turned off, the pressing mechanism 130 moves upward and is lifted upward by a restoring force of a spring 134. As a result, the contact part 131*a* and the contact part 131*b* move away from the snap action springs 123*a* and 123*b*, the movable contact 121*a* moves away from the fixed contact

111*a*, the movable contact 121*b* moves away from the fixed contact 111*b*, and the connector is turned off.

Figure 36:
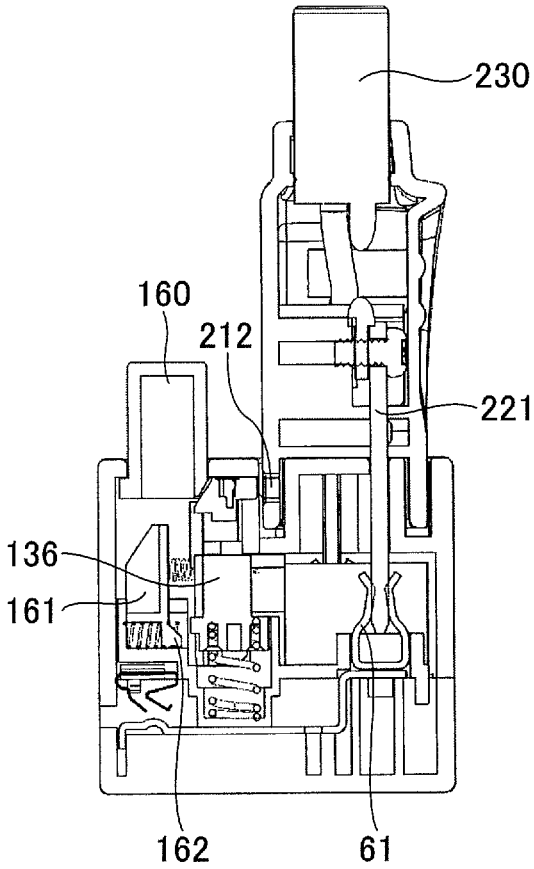
FIG. 36 is a perspective view of the connector in an OFF state according to the second embodiment.
Figure 37:
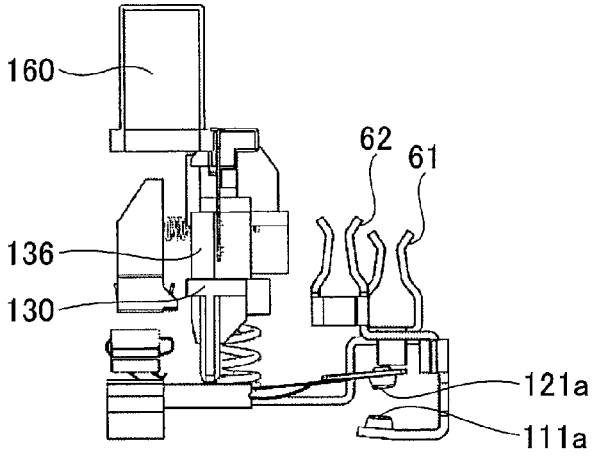
FIG. 37 is a side view of the connector in an OFF state according to the second embodiment.

Next, the push switch operation part 160 of the connector of the present embodiment is described. As illustrated by FIGS. 36 and 37, when the connector of the present embodiment and the plug connector 200 are fitted together and the push switch operation part 160 is turned off, the jack terminal 62 of the connector of the present embodiment and the plug terminal 222 of the plug connector 200 are fitted together, and the jack terminal 63 of the connector of the present embodiment and the plug terminal 223 of the plug connector 200 are fitted together. However, because the pressing mechanism 130 is not being pressed by the protrusion 136, the fixed contact 111*a* and the movable contact 121*a* are not in contact with each other, and the fixed contact 111*b* and the movable contact 121*b* are not in contact with each other. Therefore, electric power is not supplied to the plug connector 200. In this state, the jack terminal 61 of the connector of the present embodiment and the plug terminal 221 of the plug connector 200 are fitted together. FIG. 36 is a cut-away side view and FIG. 37 is a partial side view of an area where the jack terminal 61 is located.

Figure 38:
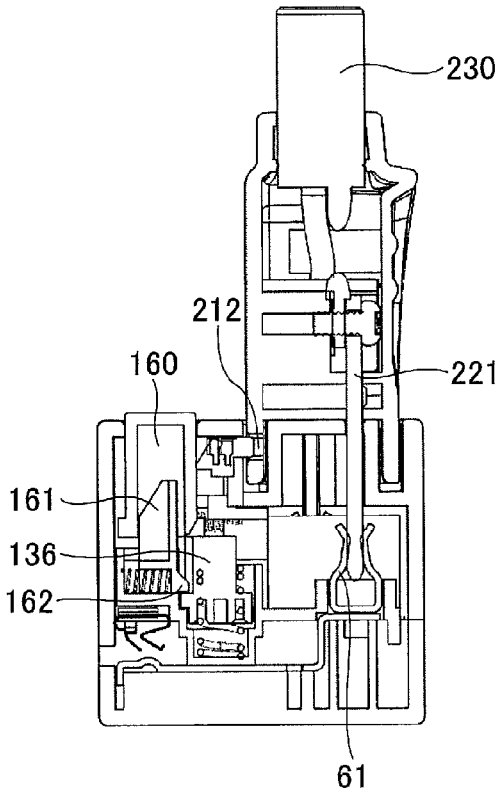
FIG. 38 is a cut-away side view of the connector in an ON state according to the second embodiment.
Figure 39:
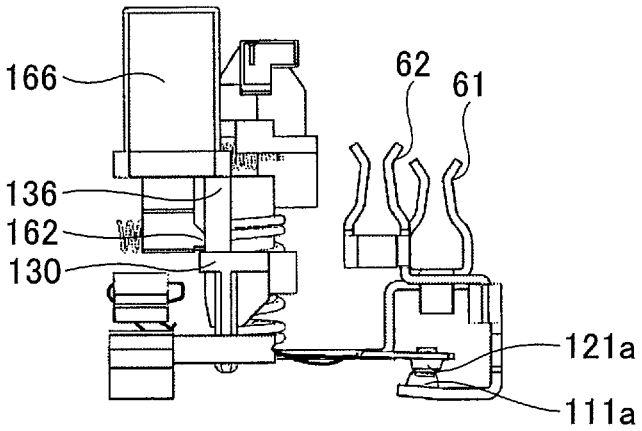
FIG. 39 is a side view of the connector in an ON state according to the second embodiment.

On the other hand, as illustrated by FIGS. 38 and 39, when the push switch operation part 160 is turned on, the protrusion 136 presses the pressing mechanism 130, the movable contact 121*a* contacts the fixed contact 111*a*, the movable contact 121*b* contacts the fixed contact 111*b*, and electric power is supplied to the plug connector 200. In the ON state, a switch lock part 161 enters the push switch operation part 160 and the position of the pressing mechanism 130 is fixed by a protrusion 162 of the switch lock part 161 to maintain the ON state. As described later, when pressed again, the push switch operation part 160 returns from the ON state into the OFF state. FIG. 38 is a cut-away side view and FIG. 39 is a partial side view of an area where the jack terminal 61 is located.

The ON and OFF operations described above are performed by operating the push switch operation part 160. That is, when the push switch operation part 160 is changed from the OFF state illustrated by FIGS. 40 through 42 into the ON state illustrated by FIGS. 43 through 45, the protrusion 136 presses the pressing mechanism 130, the pressed pressing mechanism 130 applies a force to the snap action springs 123*a* and 123*b*, the movable contact 121*a* contacts the fixed contact 111*a*, and the movable contact 121*b* contacts the fixed contact 111*b*. In this state, the switch lock part 161 enters the push switch operation part 160 and the pressing mechanism 130 is locked by the protrusion 162 of the switch lock part 162 to maintain the ON state. A part of the switch lock part 161 that contacts the inner surface of the push switch operation part 160 is formed as a sloping part 163. When the push switch operation part 160 is pressed, the switch lock part 161 moves along the sloping part 163 into the push switch operation part 160, and the protrusion 162 fixes the position of the pressing mechanism 130.

Figure 40:
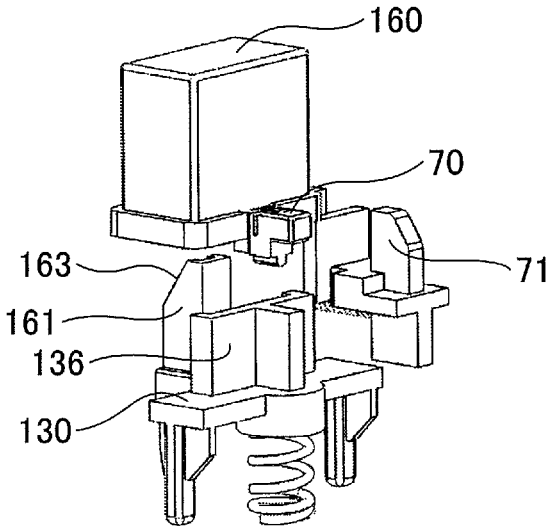
FIG. 40 is a perspective view of a push switch operation part in an OFF state.
Figure 41:
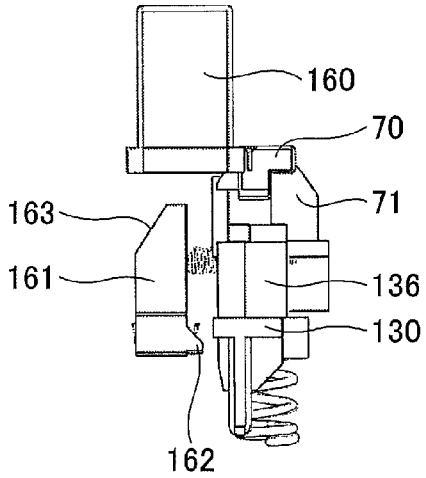
FIG. 41 is a side view of the push switch operation part in an OFF state.
Figure 42:
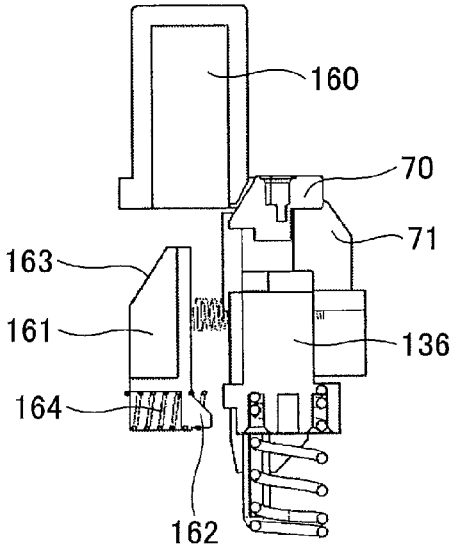
FIG. 42 is a cut-away side view of the push switch operation part in an OFF state.
Figure 43:
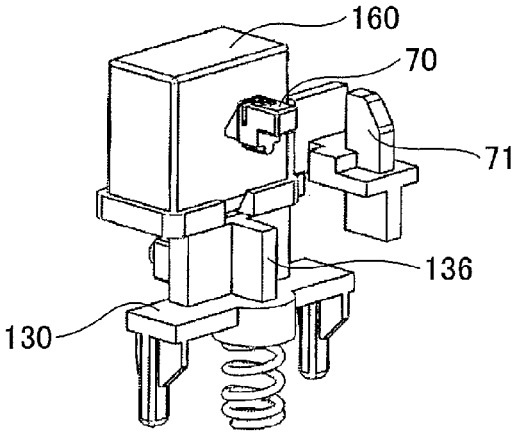
FIG. 43 is a perspective view of the push switch operation part in an ON state.
Figure 44:
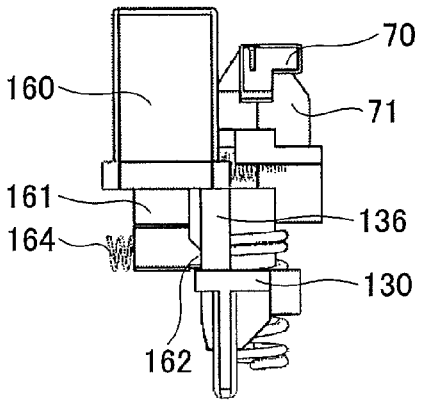
FIG. 44 is a side view of the push switch operation part in an ON state.
Figure 45:
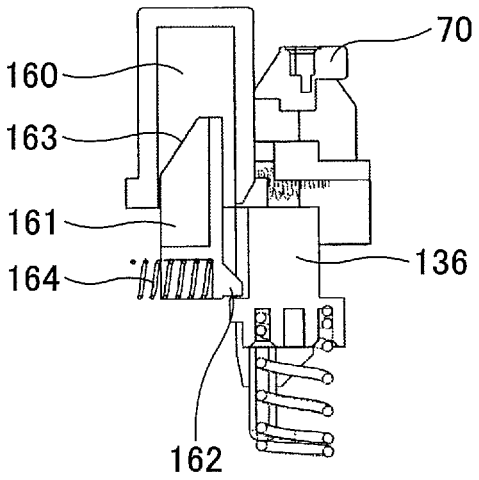
FIG. 45 is a cut-away side view of the push switch operation part in an ON state.

When the push switch operation part 160 in the ON state is pressed again, the switch lock part 161 is caused by a restoring force of a spring 164 to move along the sloping part 163 out of the push switch operation part 160, and the protrusion 162 fixing the position of the pressing mechanism 130 also moves. As a result, the pressing mechanism 130 moves upward, and the push switch operation part 160 returns to the OFF state. FIG. 40 is a perspective view, FIG. 41 is a side view, and FIG. 42 is a cut-away side view of a part of the internal structure of a switch of the present embodiment in the OFF state. FIG. 43 is a perspective view, FIG. 44 is a side view, and FIG. 45 is a cut-away side view of a part of the internal structure of a switch of the present embodiment in the ON state.

Operations to turn on and off the push switch operation unit 160 can be performed while the plug connector 200 is inserted in (or fitted into) the connector of the present embodiment. When the plug connector 200 is not inserted in the connector of the present embodiment, the push switch operation unit 160 cannot be turned on, i.e., is kept in the OFF state, and electric power is not supplied to the jack terminals 62 and 63.

Configurations of the connector of the second embodiment other than those described above are substantially the same as those of the first embodiment.

Embodiments of the present invention are described above. However, the present invention is not limited to the specifically disclosed embodiments, and variations and modifications may be made without departing from the scope of the present invention.

The present application is based on and claims the benefit of priority of Japanese Patent Application No. 2011-176411 filed on Aug. 11, 2011, the entire contents of which are hereby incorporated herein by reference.

EXPLANATION OF REFERENCES

21 Jack opening
22 Jack opening
23 Jack opening
31 Groove
40 Seesaw switch operation part
41 Torsion spring
50 Case
61 Jack terminal
62 Jack terminal
63 Jack terminal
70 Hook
71 Protrusion
72 Spring
110*a*, 110*b* Fixed part
111*a*, 111*b* Fixed contact
112*a*, 112*b* Connecting part
120*a*, 120*b* Movable part
121*a*, 121*b* Movable contact
122*a*, 122*b* Movable plate
123*a*, 123*b* Snap action spring
125*a* Spring body
126*a* Curved part
127*a* Curved part end
128*a* Movable part mounting part
129*a* Mounting part end
130 Pressing mechanism
131*a*, 131*b* Contact part
132 Body
133 Press contact part
134 Spring
140 Ring
141 Pressing part
200 Plug connector
210 Cover
211 Protection part
212 Connector connection opening
221 Plug terminal
222 Plug terminal
223 Plug terminal
230 Power cable

The invention claimed is:

1. A connector, comprising:

a connecting terminal to be connected to another connecting terminal of another connector;

a fixed contact;

a movable contact that comes into contact with the fixed contact;

an operation part that moves according to an operation by an operator; and a hook that moves in accordance with the movement of the operation part, wherein the hook moves and enters an opening of the another connector when the operation part is moved in a direction to cause the movable contact to contact with the fixed contact.

2. The connector as claimed in claim 1, wherein a direction in which a force to operate the operation part is applied is substantially parallel to a direction in which a force to move the movable contact and cause the movable contact to contact with the fixed contact is applied, and to a direction in which the movable contact moves.

3. The connector as claimed in claim 1, wherein the hook moves in a direction perpendicular to a direction of connecting the another connector to the connector.

4. A connector to be connected to another connector, the connector comprising:

a fixed contact;

a movable contact that comes into contact with the fixed contact;

a movable spring that is biased in a direction in which the movable contact moves away from the fixed contact;

an operation part that moves in accordance with an operation by an operator;

a mechanism that moves in a direction substantially parallel to a direction in which the movable contact moves; and a link in which one end is rotatably connected to the operation part and another end is rotatably connected to the mechanism, wherein when the operation part is operated while the movable contact is away from the fixed contact, the mechanism moves and presses the movable spring to cause the movable contact to contact with the fixed contact; and when the operation part is operated while the movable contact is in contact with the fixed contact, the mechanism moves in a direction to release the movable spring and the movable contact moves away from the fixed contact by a spring force of the movable spring.

5. A connector, comprising:

a connecting terminal to be connected to another connecting terminal of another connector;

a fixed contact;

a movable spring;

a movable contact that comes into contact with the fixed contact;

a seesaw switch that rotatably moves between a first position and a second position in connection with an operation by an operator, and is biased toward the first position;

a pressing part that moves in accordance with the movement of the seesaw switch; and a link that connects the seesaw switch and the pressing part, wherein when the seesaw switch is operated from the first position to the second position, the pressing part moves so as to cause the movable contact to come into contact with the fixed contact, and when the seesaw switch is operated from the second position to the first position, the pressing part moves so as to cause the movable contact to move away from the fixed contact.

6. The connector as claimed in claim 5, further comprising:

a pressing mechanism that presses the movable spring so as to move the movable contact toward the fixed contact, wherein when the seesaw switch is operated from the first position to the second position, the pressing part moves and presses the pressing mechanism so as to press the movable spring and cause the movable contact to come into contact with the fixed contact, and when the seesaw switch is operated from the second position to the first position, the pressing part moves away from the pressing mechanism, and the pressing mechanism moves so that the movable contact moves away from the fixed contact.

* * * * *